US007166991B2

(12) United States Patent
Eberlein

(10) Patent No.: US 7,166,991 B2
(45) Date of Patent: Jan. 23, 2007

(54) ADAPTIVE BIASING CONCEPT FOR CURRENT MODE VOLTAGE REGULATORS

(75) Inventor: Matthias Eberlein, Gilching (DE)

(73) Assignee: Dialog Semiconductor GmbH, Kirchheim/Teck-Nabern (DE)

( * ) Notice: Subject to any disclaimer, the term of this patent is extended or adjusted under 35 U.S.C. 154(b) by 314 days.

(21) Appl. No.: 10/948,008

(22) Filed: Sep. 23, 2004

(65) Prior Publication Data

US 2006/0055383 A1 Mar. 16, 2006

(30) Foreign Application Priority Data

Sep. 14, 2004 (EP) ..... 04368063

(51) Int. Cl.
*G05F 1/56* (2006.01)

(52) U.S. Cl. ..... 323/280; 323/316

(58) Field of Classification Search ..... 323/273, 323/280, 315, 316

See application file for complete search history.

(56) References Cited

U.S. PATENT DOCUMENTS

| | | | | |
|---|---|---|---|---|
| 5,559,423 | A * | 9/1996 | Harman | 323/277 |
| 6,046,577 | A | 4/2000 | Rincon-Mora et al. | 323/282 |
| 6,246,221 | B1 * | 6/2001 | Xi | 323/280 |
| 6,300,749 | B1 * | 10/2001 | Castelli et al. | 323/273 |
| 6,465,994 | B1 | 10/2002 | Xi | 323/274 |
| 6,518,737 | B1 | 2/2003 | Stanescu et al. | 323/280 |
| 6,580,257 | B1 * | 6/2003 | Marty | 323/280 |
| 6,703,813 | B1 | 3/2004 | Vladislav et al. | 323/270 |
| 6,703,816 | B1 * | 3/2004 | Biagi et al. | 323/280 |
| 6,975,099 | B1 * | 12/2005 | Wu et al. | 323/280 |
| 2002/0130646 | A1 | 9/2002 | Zadeh et al. | 323/275 |

FOREIGN PATENT DOCUMENTS

| | | |
|---|---|---|
| EP | 899643 A | 3/1999 |
| EP | 378808 A | 1/2004 |

OTHER PUBLICATIONS

"A Low-Voltage, Low Quiescent Current, Low Drop-Out Regulator", by Gabriel et al., IEEE Jrnl. of Solid-State Circuits, vol. 33, No. 1, Jan. 1998, pp. 36-44.

"Adaptive Biasing CMOS Amplifiers", by Degrauwe et al., IEEE Jrnl. of Solid-State Circuits, vol. SC-17, No. 3, Jun. 1982, pp. 522-528.

* cited by examiner

*Primary Examiner*—Jeffrey Sterrett
(74) *Attorney, Agent, or Firm*—Saile Ackerman LLC; Stephen B. Ackerman

(57) ABSTRACT

Circuits and methods to achieve dynamic biasing for the complete loop transfer function of a current mode voltage regulator have been achieved. The circuit comprises a Mirror-Transconductor Amplifier type operational transconductance amplifier (OTA) wherein its transconductance is linearly dependent on its biasing current. This biasing current is a linearly derivative of the OTA's output current. A current amplification circuit couples the regulator output current linearly with said OTA's output current. In this configuration the iterative biasing of the OTA forms a feed-forward loop, which contains a low-pass filter for stability and a negative feedback loop is closed by connecting the regulator voltage output to the OTA input. The invention realizes a purely current mode regulator since all internal currents are generated as a fraction of the output load.

26 Claims, 3 Drawing Sheets

ADAPTIVE BIASING CONCEPT FOR CURRENT MODE VOLTAGE REGULATORS

BACKGROUND OF THE INVENTION (1) Field of the Invention

This invention relates generally to voltage regulators, and more particularly to a current mode low dropout (LDO) voltage regulator having a linear adaptive biasing current technique.

(2) Description of the prior Art

Low-dropout (LDO) linear regulators are commonly used to provide power to low-voltage digital circuits, where point-of-load regulation is important. In these applications, it is common for the digital circuit to have different modes of operation. As the digital circuit switches from one mode of operation to another, the load demand on the LDO can change quickly. This quick change of load results in a temporary glitch of the LDO output voltage. Most digital circuits do not react favorably to large voltage transients. An important goal for voltage regulators is to isolate sensitive circuitry from the transient voltage changes of the battery.

Conventional LDO regulators are very problematic in the area of transient response. The transient response is the maximum allowable output variation for a load current step change and must be frequency compensated in order to ensure a stable output voltage. Conventional means to compensate frequency dependencies are limiting the load regulation performance and the accuracy of the output.

Linear voltage regulators (LDO's) have either a fixed biasing current, which results in poor efficiency for small load currents, or they have a (nonlinear) dynamic biasing current, which changes the internal operating point when the load varies. This negatively affects stability and requires a large silicon area for compensation. Further the LDO suffers in one or the other way because of these variations.

LDOs generally should consume little standby current and silicon area. Depending on the application they must achieve good performance values in terms of power supply rejection (PSSR), transient response to load current changes, and DC regulation accuracy. Conventional LDOs require a large capacitor for "Miller compensation" to stabilize the regulator feedback loop under all operating conditions.

There are patents known dealing with these problems as PSSR, transient response to load current changes and regulation accuracy:

U.S. Pat. No. (6,703,813 to Vladislav et al.) describes an LDO regulator arranged to provide regulation with a pass device, a cascode device, a level shifter, an error amplifier, and a tracking voltage divider. The error amplifier is arranged to sense the output voltage and provide an error signal to the pass device via the level shifter. The level shifter changes the DC level of the error signal such that the pass device is isolated from damaging voltages. The cascode device is arranged to increase the impedance between the output node and the pass transistor such that the LDO regulator can sustain input voltages that exceed process limits without damage. The cascode device is biased by the tracking voltage divider. The tracking voltage divider adjusts the biasing to the cascode device such that a decreased input voltages result in lower impedance, and increased input voltages result in higher impedance.

U.S. Pat. No. (6,046,577 to Rincon-Mora et al.) discloses an improved low-dropout ("LDO") voltage regulator incorporating a transient response boost circuit which is added to the slew-rate limited node at the control terminal of the LDO voltage regulator output transistor and providing improved transient response performance to the application of various load current step stimuli while requiring no standby or quiescent current during zero output current load conditions. The transient boost circuit supplies current to the slew-rate limited node only upon demand and may be constructed as either a localized positive feedback loop or a number of switching devices, which conduct current only during slew-rate conditions.

U.S. Pat. No. (6,518,737 to Stanescu et al.) discloses a low dropout voltage regulator with non-Miller frequency compensation. The LDO circuit has two wide-band, low-power cascaded operational transconductance amplifiers (OTAs): an error amplifier and a unity-gain-configured voltage follower. The unity-gain-configured voltage follower drives a gate of a power PMOS path transistor with a high parasitic gate capacitance. The wide-band, low-power OTAs enable the use of a single, low-value load capacitor with a low equivalent series resistance (ESR). A frequency compensation capacitor is connected in parallel with the upper resistor of a feedback network, which introduces a zero-pole pair that enhances the phase margin close to unity-loop-gain frequency.

Furthermore Gabriel Rincon-Mora describes "A low-Voltage, Low-quiescent Current LDO Regulator" in IEEE Journal of Solid States Circuits, Vol 33, no 1, January 1998 and Marc G. Degrauwe et al. describe "Adaptive Biasing CMOS Amplifiers!" in IEEE Journal of Solid States Circuits" Vol. 17, no. 3, June 1982.

SUMMARY OF THE INVENTION

A principal object of the present invention is to achieve a current mode voltage regulator applying dynamic biasing for the complete loop transfer function.

Another principal objective of the invention is to achieve a voltage regulator having constant performance properties over a large dynamic range.

Another principal object of the present invention is to achieve a method for dynamic biasing for the complete loop transfer function of a current mode voltage regulator.

In accordance with the objects of this invention a circuit for a current mode voltage regulator having dynamic biasing for the complete loop transfer function has been achieved. Said circuit is comprising, firstly, an operational transconductance amplifier (OTA), wherein its effective transconductance gm is linearly dependent upon its biasing current, having inputs and an output, wherein its output is connected to a means of constant current amplification and the inputs are a reference voltage, a feedback voltage from a voltage divider, wherein said biasing current, which is generated by amplification of the output current of said OTA using a constant current amplification factor is forming a feed forward loop. Secondly, the circuit invented comprises said means of constant current amplification having an input and two outputs, wherein its input is said output current of said OTA and a first output is said biasing current of said OTA and a second output is the output current of said voltage regulator. Furthermore the circuit comprises a low-pass filter stabilizing said biasing current, and said voltage divider providing a voltage being linearly correlated to the output voltage of said voltage regulator and wherein said voltage provided by the voltage divider is used as an input of said OTA forming a negative feedback loop by connecting the regulator output to the OTA input.

In accordance with the objects of this invention a circuit to for a current mode voltage regulator having dynamic biasing for the complete loop transfer function has been achieved. The circuit invented comprises, firstly, an OTA from a Mirror-Transconductor Amplifier type, wherein its effective transconductance gm is linearly dependent upon its biasing current, having inputs and an output, comprising a differential amplifier and a first current mirror configuration, wherein the output of the OTA is connected to a second current mirror configuration for current amplification and a first input of said differential amplifier is a reference voltage and a second input of said differential amplifier is a feedback voltage from a voltage divider, and said current biasing said differential amplifier is generated by amplification of the output current of the OTA using a constant current amplification factor, wherein said biasing current forms a feed forward loop. Secondly, the circuit invented comprises said second current mirror configuration for current amplification having an input and two outputs, wherein its input is said output current of said OTA and a first output is said biasing current of said OTA and a second output is the output current of said voltage regulator. Thirdly, the circuit comprises a gmc-filter type low-pass filter stabilizing said biasing current comprising a current mirror and a capacitor wherein said current mirror is amplifying said biasing current. Furthermore the circuit comprises said voltage divider providing a voltage being linearly correlated to the output voltage of said voltage regulator, which is connected to the second input of said differential amplifier forming a negative feedback loop by connecting the regulator output to the OTA input.

In accordance with the objects of this invention a method for a current mode voltage regulator to achieve dynamic biasing for the complete loop transfer function has been reached. The method invented comprises, firstly, the provision of a current mode voltage regulator comprising an operational amplifier (OTA) having a transconductance, which is linearly dependent on its biasing current, a low-pass filter, a voltage divider, and a current amplifier. The next steps of the method are to feed a voltage representing the output voltage of said regulator back to said OTA, to use said voltage of the previous step to control the output current of said OTA, and to amplify said output current of said OTA using a constant current amplification factor to generate a biasing current of said OTA; stabilize said biasing current of said OTA; and amplify said output current of said OTA using a constant current amplification factor to generate the output current of the regulator.

BRIEF DESCRIPTION OF THE DRAWINGS

In the accompanying drawings forming a material part of this description, there is shown.

DESCRIPTION OF THE PREFERRED EMBODIMENTS

The preferred embodiments of the present invention disclose novel circuits and methods for current mode LDO voltage regulators achieving a constant and high efficiency of higher than 99.5% without requiring a large "Miller compensation" capacitor to stabilize the regulator feedback loop under all operating conditions.

Key point of the invention is that the complete LDO is dynamically biased depending on the output load in a strictly linear way. The new structure has a transfer function, which is highly predictable since it depends mainly on external components and physical constants and not on process variations. Especially the constant DC-loop gain is a key factor. It allows a simple frequency compensation determined only by the external load outside the chip. As a result the stability condition (phase margin) remains constant over the complete operating range.

Figure 1:
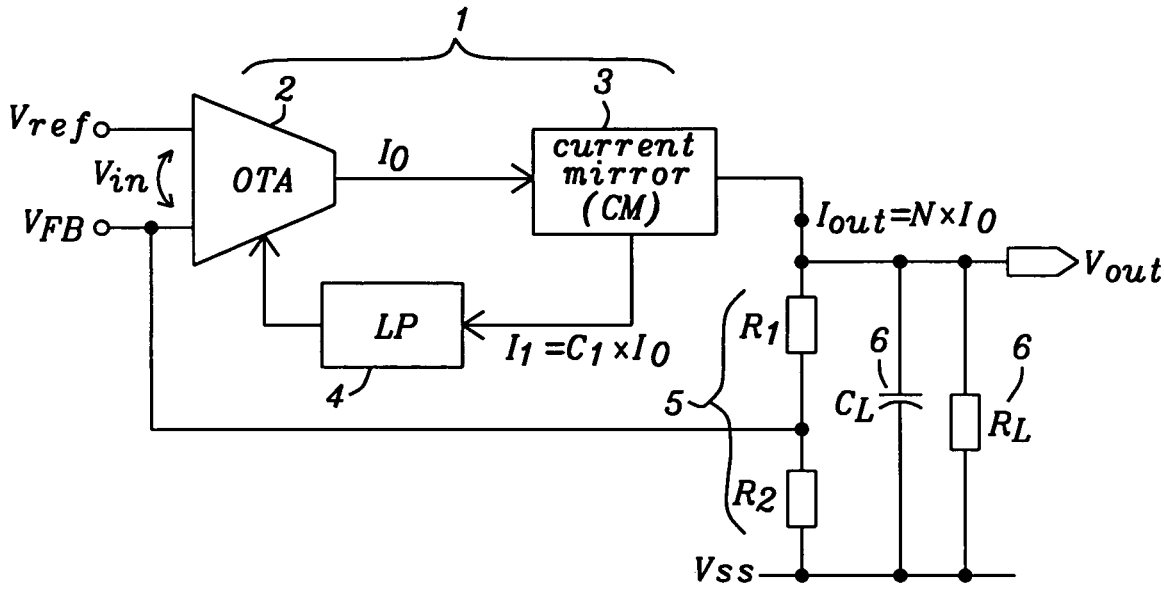
FIG. 1 shows a principal block diagram of the present invention.

FIG. 1 shows a principal block diagram of the present invention showing an adaptive biasing concept for a current mode voltage regulator 1. The voltage regulator 1 comprises an operational transconductance amplifier (OTA) 2, a current mirror configuration 3, a low-pass filter LP 4, a voltage divider 5, and an output load 6, represented by capacitor CL and resistor RL.

The voltage divider 5, comprising resistors R1 and R2, provides a feedback voltage vfb, being proportional to the output voltage Vout. This voltage vfb is fed back to a second input of the OTA 2.

The OTA is a transconductance device type, which means that the input voltage controls an output current by means of the device transconductance gm. This makes the OTA a voltage-controlled current source. The input voltage vin of the OTA 2 results from the difference between the reference voltage Vref, being the first input of the OTA 2, and the feedback voltage Vfb. The output current io of the OTA 2 results from:

$$io = gm(OTA) \times vin,$$

wherein gm(OTA) is the transconductance of OTA 2.

Figure 2:
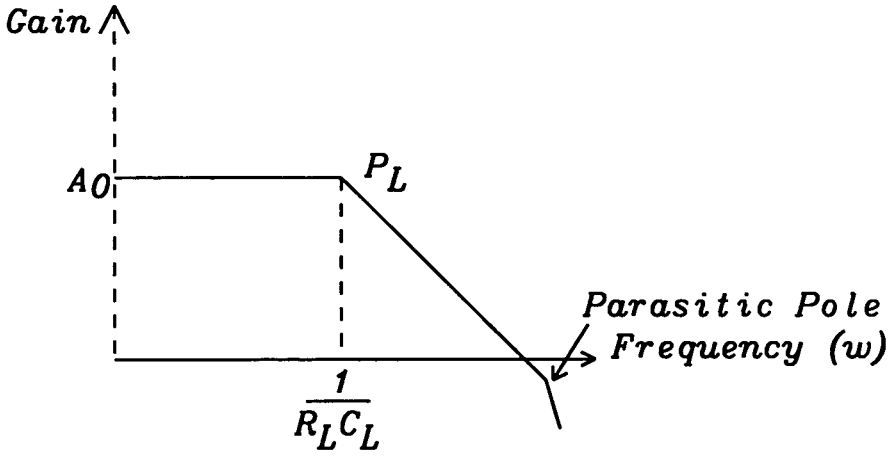
FIG. 2 illustrates the transfer function of the regulation loop of the voltage regulator invented.

For the sake of technical correctness in this context it will be distinguished here between "small signal" behavior, in this description referred to with small letters, and "large signal" behavior, referred to using capital letters, like used in FIG. 1 and FIG. 2.

Basic OTA functions are described therefore by their "small signal" behavior, which is the mathematical derivation of a large signal versus time. As a consequence vin in the circuit of FIG. 1 becomes equal to the negative value of vfb because Vref is a constant voltage and vin=Vref−Vfb.

One important feature of the OTA of the present invention is that its effective small signal transconductance gm is linearly (!) dependent on the biasing current I1.

The biasing current I1 can be derived from the output current Io of the OTA 2 at any point. It is derived in a way that $$I1 = C1 \times Io,$$

wherein in a preferred embodiment the constant C1 factor is e.g. 2. This value of 2 for C1 is a non-limiting example only. Said current I1, after passing low-pass filter LP 4, is the main biasing current of OTA 2. In this way a feed forward loop is implemented from current Io to current I1 and again to Io.

The OTA of the present invention has a behavior described by:

$$io = C_{OTA} \times I1 \times vin,$$

wherein $C_{OTA}$ is a parameter determined by design and by physical constants.

Another important point of the present invention is that the current mirror configuration 3 provides a linear relation between the output current of the OTA Io, the biasing current I1, and the output current of the LDO 1 IOUT. The LDO output current IOUT is defined by $$I_{OUT}=N\times Io,$$

wherein N is a constant factor being defined in the current mirror configuration internally. Thus the biasing current I1 is controlled linearly by a fraction of the output current IOUT and provides a dynamic biasing loop acting with positive feedback. The biasing current I1, a linear derivative of IOUT and of Io, must further pass the low-pass filter 4 providing stability to this dynamic biasing loop. This low-pass filter 4 generally modifies the small signal component of the biasing current I1 versus frequency, not its large signal value.

It should be understood that the current mirror configuration could be as well any other construction which delivers a regulator output current IOUT being linearly dependent on the output current Io of the OTA 2. This could be e.g. a pure current mirror configuration or some other amplifier/buffer stage. It has to perform a linear current amplification from the output current Io of the OTA 2 to the biasing current I1 and to the output current Iout of the regulator.

The regulation loop is specified by the equation $$A(s)=\frac{-A_0\times Z_f}{P_f\times P_i},\ \text{wherein} \tag{1}$$

$$A_0=\frac{V_{ref}\times b}{2\times V_t}, \tag{1}$$

$$Z_f=1+s\times\left(\frac{C_f}{gmf}-\frac{C_L\times R_L}{A_0}\right),$$

$$P_f=1+s\times\left(\frac{C_f}{gmf}\right),\ \text{and}$$

$$P_L=1+s\times C_L\times R_L,$$

wherein RL and CL represent the resistance and the capacitance of the load of the regulator and Vt means thermal voltage, a physical constant. The parameter b is defined by the OTA design and represents a current gain factor determining the loop transfer gain A0. The factor Zf must be adjusted for stability through Cf/gmf and cancels the "filter-pole" Pf, if the term Cf/gmf is chosen large during component design. The result is a transfer function, which has only one dominant pole (PL) at the output only. This dominant pole is defined only by the load $$\frac{1}{R_L\times C_L}.$$

The equation above illustrates clearly the advantages of the present invention. The dc-gain is well defined by A0 and does not depend upon device parameters (like transconductance gm) or upon the operating point. Furthermore, if the gain and the dominant pole is known, such "single-pole" system can easily be stabilized, without the requirement of a large compensation capacitor. Another advantage is that mirror mismatches have no influence and the ratio 1:N of the amplification from the current Io to the output current IOUT of the regulator does not even appear in the equation above.

FIG. 2 illustrates the transfer function of the regulation loop of the present invention. It shows a constant gain over a large dynamic range until the dominant pole PL is reached. The parasitic pole is not relevant for the regulator of the present invention.

Figure 3:
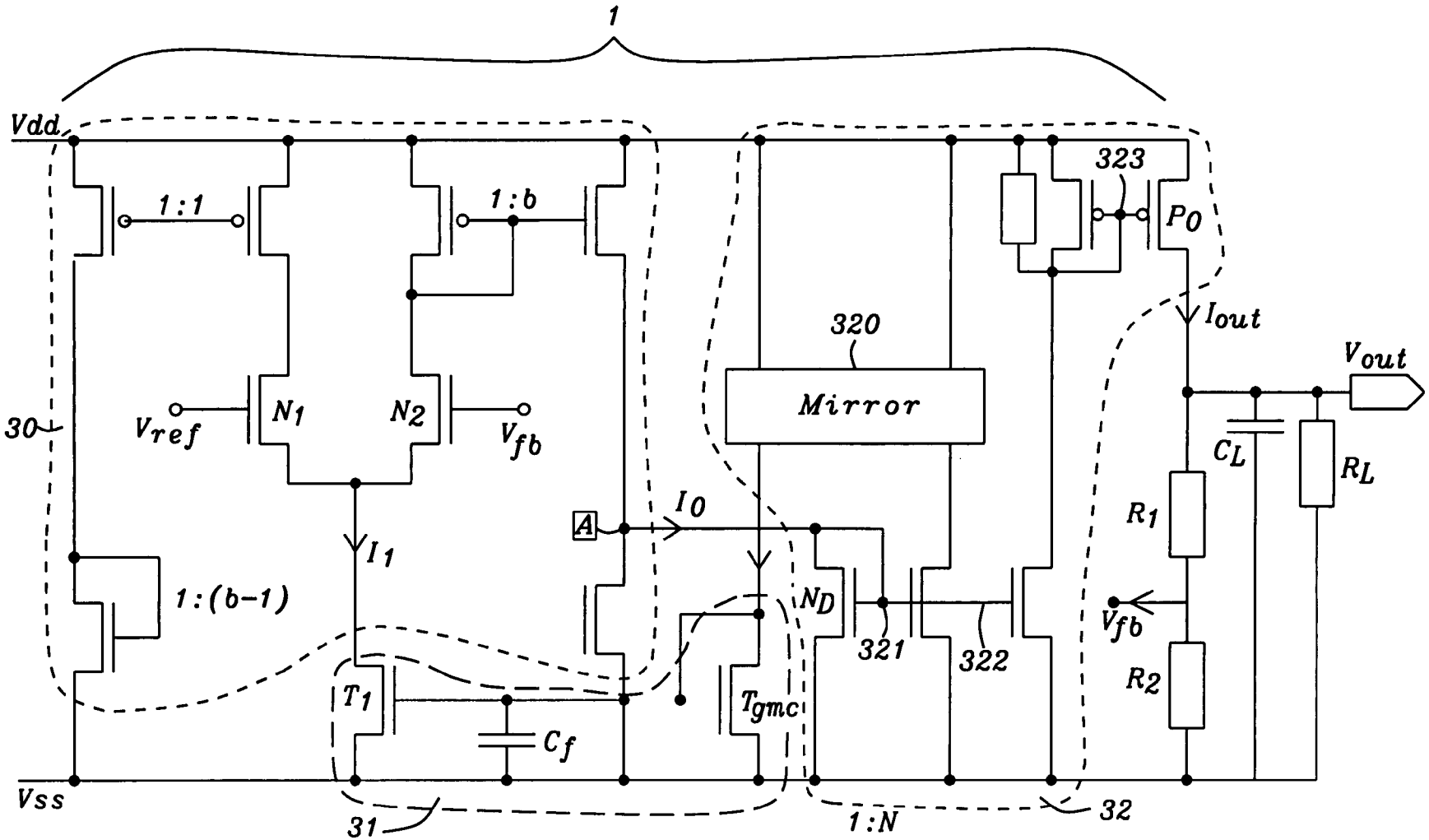
FIG. 3 shows a more detailed diagram of the circuit invented.

FIG. 3 shows in more detail than in FIG. 1 a preferred embodiment of the invention. A first part 30 of the circuitry comprises an OTA, a second part 31 of the circuitry comprises a low-pass-filter and a current mirror comprising transistors T1 and Tgmc to amplify the output current Io of the OTA to generate the biasing current I1, a third part 32 of the circuitry comprises a current mirror configuration including current mirrors 321, 322 and 323 to amplify the output current Io of the OTA 30 using an overall scale of 1:N to generate the output current Iout of the regulator. In a preferred embodiment, as a non-limiting example a scale of 1:2 is used by the combination of the current mirror T1/Tgmc and current mirror 320 to generate the biasing current I1. Any current mirror configuration can be used to achieve a total scale of e.g. 1:2 for the relationship Io to I1. As a non-limiting example, in a preferred embodiment current mirror 320 has a scale of 1:1 and the size of transistor T1 is twice the size of transistor Tgmc. It has to be understood that instead of the output stage comprising current mirror 323 any other output stage could be used as long as a linear current amplification from the output current Io of the OTA using an overall scale of 1:N to the output current Iout is performed.

Furthermore the circuitry of FIG. 3 comprises the same voltage divider 5 built using resistors R1/R2 as shown also in FIG. 1. It has to be understood that the scale of 1:2 of the amplification to generate the biasing current I1 is an example only and depends upon the specific design of the OTA 30.

The biasing current I1 biases a differential input amplifier, formed by transistors N1 and N2 and is controlled linearly by a fraction of the output voltage VOUT of the regulator 1 via the mid-voltage Vfb of the voltage divider 5 formed by resistors R1/R2 (the connection between the voltage divider and the input of the differential amplifier is identified by the node Vfb but is not shown). The other input of said differential amplifier is provided by the reference voltage Vref. The input pair of said differential amplifier, formed by transistors N1 and N2, needs to work to work in weak inversion region and the output at node A needs to be loaded by a diode connected MOSFET ND, e.g. the input device of the current mirror 321.

Said differential amplifier is part of a Mirror-Transconductance Amplifier (OTA) 30 having a mirror ratio of 1:b respective 1:(b−1). The factor b determines the loop transfer gain A0 as shown above in equation (1). Said loop transfer gain A0 can be adjusted by varying this factor b to find an optimum between good stability (small A0) and performance (larger A0).

The output node A is directly connected via the diode connected MOSFET ND to the current mirror configuration 32 with the last mirror device being the output drover PO. The output current IOUT of the regulator has been amplified in the relation 1:N from the output current Io of the OTA 30. The amplification 1:N is performed gradually throughout the current mirrors 321, 322, and 323 to keep the influence of parasitic capacitances low. It has to be understood that the output stage of a preferred embodiment comprising current mirror 323 as shown in FIG. 3 is an example only. The adaptive biasing concept of the present invention may also use other output stages as long as a linear current amplification from Io to IOUT is performed.

In this specific preferred embodiment the biasing current I1 is set by definition of the current mirror T1/Tgmc to e.g. 2×Io. The low-pass filter 31 is realized by capacitor Cf and said MOSFET Tgmc of the current mirror mentioned above having a transconductance gmf. This low-pass filter is of a gmc-filter type.

In summary the present invention describes a current mode voltage regulator having a dynamic biasing loop having an output current of an OTA circuit block:

$$io = C_{OTA} \times I1 \times vin,$$

wherein the biasing current I1 is a linear derivative of the OTA's output current, together with a current amplification circuit, which couples the regulator, output current $I_{OUT}$ linearly with Io. In this configuration the iterative biasing of the OTA forms a forward loop, which must contain a low-pass filter for stability. Furthermore a negative feedback loop is closed by connecting the regulator output voltage to the OTA input.

Figure 4:
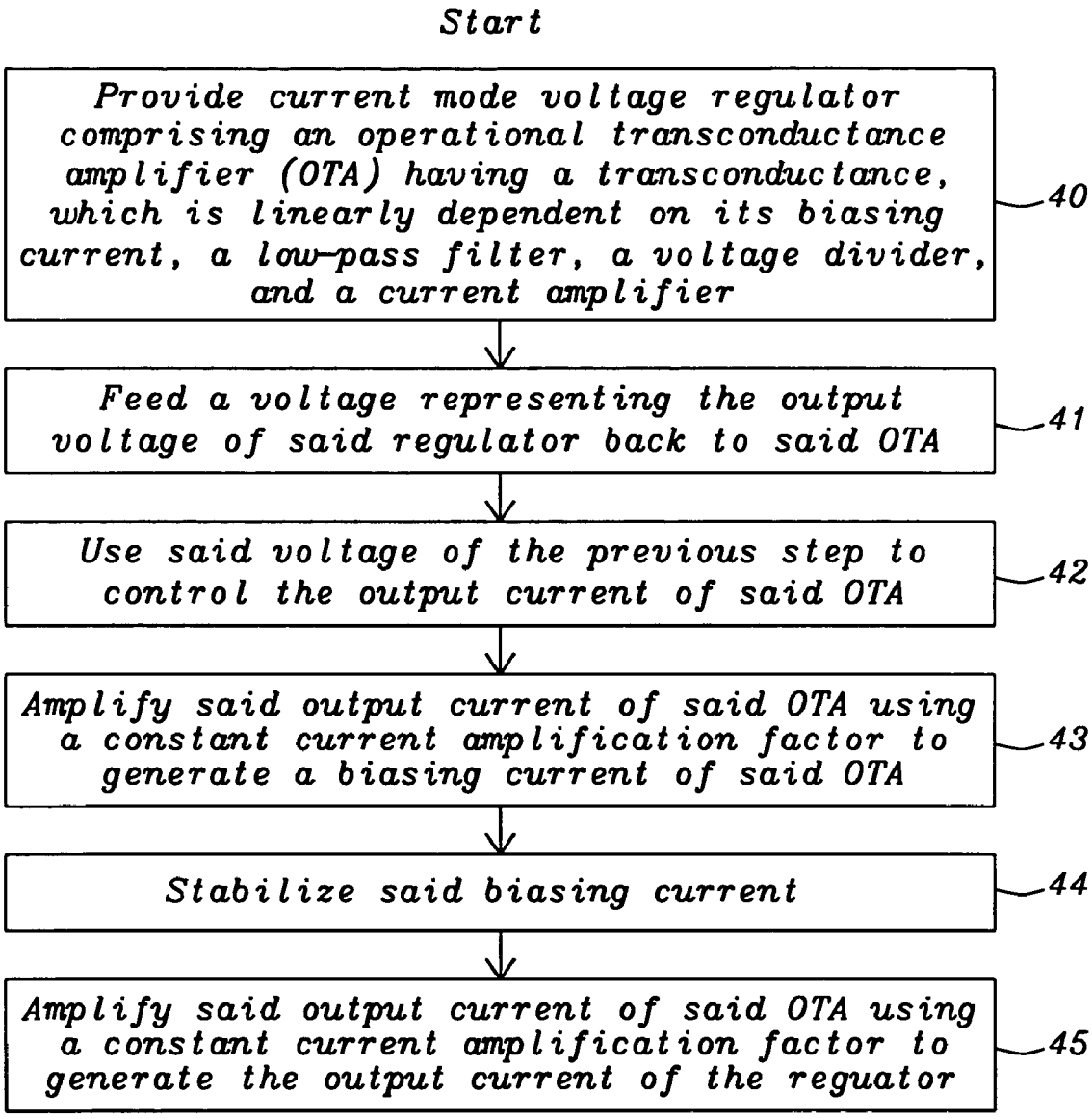
FIG. 4 shows a flowchart of the method invented to achieve a current mode regulator having a linear adaptive biasing scheme.

FIG. 4 describes a method to achieve a current mode regulator having a linear adaptive biasing scheme. The first step 40 describes the provision of a current mode voltage regulator comprising an operational transconductance amplifier (OTA) having a transconductance, which is linearly dependent on its biasing current, a low-pass filter, a voltage divider, and a current amplifier. The next step 41 shows the feedback of a voltage representing the output voltage of said regulator back to said OTA. In the following step 42 said voltage of the previous step is used to control the output current of said OTA, followed by the next step 43 in which said output current of said OTA is amplified using a constant current amplification factor to generate a biasing current of said OTA. Said biasing current is stabilized in step 44 and, finally, in step 45 said output current of said OTA gets amplified using a constant current amplification factor to generate the output current of the regulator.

The invention realizes a purely current mode regulator since all internal currents are generated as a fraction of the output load. In prior art, dynamic biasing is sometimes used as well but only to parts of the regulation path. A key of the present invention is that its dynamic biasing affects and determines the complete loop transfer function.

The advantages of the present invention are that the loop transfer function depends not on process fabrication or matching properties or output voltage a simple external frequency scheme doesn't need a large integrated capacitor the performance values don't change over a large dynamic range having inherently a good PSSR, and the regulator has a very low stand-by current and a constant high current efficiency While the invention has been particularly shown and described with reference to the preferred embodiments thereof, it will be understood by those skilled in the art that various changes in form and details may be made without departing from the spirit and scope of the invention.

The invention claimed is:

1. A circuit for a current mode voltage regulator having dynamic biasing for the complete loop transfer function is comprising:

an operational transconductance amplifier (OTA), wherein its effective transconductance gm is linearly dependent upon its biasing current, having inputs and an output, wherein its output is connected to a means of constant current amplification and the inputs are a reference voltage and a feedback voltage from a voltage divider, wherein said biasing current, which is generated by amplification of the output current of said OTA using a constant current amplification factor is forming a feed forward loop;

said means of constant current amplification having an input and two outputs, wherein its input is said output current of said OTA and a first output is said biasing current of said OTA and a second output is the output current of said voltage regulator;

a low-pass filter stabilizing said biasing current; and said voltage divider providing a voltage being linearly correlated to the output voltage of said voltage regulator and wherein said voltage provided by the voltage divider is used as an input of said OTA forming a negative feedback loop by connecting the regulator output to the OTA input.

2. The circuit of claim 1 wherein said voltage divider comprises two resistors.

3. The circuit of claim 2 wherein said OTA is of the Mirror-Transconductor amplifier type comprising a differential amplifier.

4. The circuit of claim 3 wherein said Mirror-Transconductor amplifier comprises two current mirrors, wherein a first current mirror has a mirror ratio of 1:b and a second current mirror has a mirror ratio of 1:(b−1), wherein b determines the loop transfer gain of said OTA.

5. The circuit of claim 4 wherein said factor b is used to define an optimal loop transfer gain of said OTA.

6. The circuit of claim 1 wherein the output current io of said OTA can be calculated by the equation:

$$io = Cota \times I1 \times vin,$$

wherein I1 is said biasing current of the OTA, vin is the differential input voltage of the OTA, and Cota is a constant parameter defined by design and physical constants.

7. The circuit of claim 1 wherein said biasing current is amplified by a factor of two from the output current of the OTA.

8. The circuit of claim 1 wherein said low-pass filter is a GMC-filter implemented using a capacitor and a MOSFET with transconductance inside a current mirror.

9. The circuit of claim 1 wherein said means of constant current amplification comprise a current mirror configuration, wherein said biasing current is amplified from said output current of said OTA by a first constant factor and the output current of the regulator is amplified from said output current of said OTA by a second constant factor.

10. The circuit of claim 1 wherein said means of constant current amplification comprise a current amplifier/buffer stage providing an output being linearly dependent upon the output current of the OTA.

11. A circuit for a current mode voltage regulator having dynamic biasing for the complete loop transfer function is comprising:

an OTA from a Mirror-Transconductor Amplifier type, wherein its effective transconductance gm is linearly dependent upon its biasing current, comprising a differential amplifier and a first current mirror configuration, having inputs and an output, wherein the output of the OTA is connected to a second current mirror configuration for current amplification and a first input of said differential amplifier is a reference voltage and a second input of said differential amplifier is a feedback voltage from a voltage divider, and said current biasing said differential amplifier is generated by amplification of the output current of the OTA using a constant current amplification factor, wherein said biasing current forms a feed forward loop;

said second current mirror configuration for current amplification having an input and two outputs, wherein its input is said output current of said OTA and a first output is said biasing current of said OTA and a second output is the output current of said voltage regulator;

a gmc-filter type low-pass filter stabilizing said biasing current comprising a current mirror and a capacitor wherein said current mirror is amplifying said biasing current; and said voltage divider providing a voltage being linearly correlated to the output voltage of said voltage regulator, which is connected to the second input of said differential amplifier forming a negative feedback loop by connecting the regulator output to the OTA input.

12. The circuit of claim 11 wherein said Mirror-Transconductor Amplifier type OTA comprises four branches of circuitry:

a first branch comprises a PMOS transistor and an NMOS transistor, wherein the source of the PMOS transistor is connected to VDD voltage and its drain is connected to the drain and gate of said NMOS transistor and wherein the source of said NMOS transistor is connected to VSS voltage;

a second branch comprises a PMOS and a NMOS transistor, wherein the source of the PMOS transistor is connected to VDD voltage and its gate is connected to the gate of the PMOS transistor of the first branch, to the drain of said PMOS transistor of the second branch and to the drain of said NMOS transistor of the second branch, wherein the gate of the NMOS transistor of the second branch is to connected to a reference voltage;

a third branch comprises a PMOS and a NMOS transistor, wherein the source of the PMOS transistor is connected to VDD voltage and its gate is connected to its drain and to the drain of said NMOS transistor of the third branch, wherein the gate of the NMOS transistor of the third branch is to connected to the mid-voltage of a voltage divider, and its source is connected to the source of the NMOS transistor of the second branch and both are connected a current source of a biasing current; and a fourth branch comprises a PMOS and a NMOS transistor, wherein the source of the PMOS transistor is connected to VDD voltage and its gate is connected to the gate of said PMOS transistor of the third branch and its drain is connected to the drain of said NMOS transistor of the fourth branch, providing the output port of said OTA, wherein the gate of the NMOS transistor of the fourth branch is to connected to the gate of said NMOS transistor of the first branch and the source of the NMOS transistor of the fourth branch is connected to VSS voltage.

13. The circuit of claim 12 wherein said PMOS transistor of the first branch and said PMOS transistor of the second branch are forming a current mirror having a scale of 1:1.

14. The circuit of claim 12 wherein said PMOS transistor of the second branch and said PMOS transistor of the third branch are forming a current mirror having a scale of 1:b, wherein b determines the loop transfer gain of said OTA.

15. The circuit of claim 14 wherein said factor b is used to define an optimal loop transfer gain of said OTA.

16. The circuit of claim 12 wherein said NMOS transistor of the first branch and said NMOS transistor of the fourth branch are forming a current mirror having a scale of 1:(b−1), wherein b determines the loop transfer gain of said OTA.

17. The circuit of claim 11 wherein said second current mirror configuration for current amplification is comprising:

a first NMOS transistor wherein its drain and gate is connected to the output of said OTA and its source is connected to VSS voltage;

a second NMOS transistor wherein its gate is connected to the gate of said first NMOS transistor, its source is connected to Vss voltage and its drain is connected to a second branch of a current mirror block;

a third NMOS transistor wherein its gate is connected to the gate of said second NMOS transistor, its source is connected to VSS voltage and its drain is connected to a first terminal of a resistor and to the drain and gate of a first PMOS transistor;

said first PMOS transistor wherein its source is connected to VDD voltage;

a second PMOS transistor wherein its gate is connected to the gate of said first PMOS transistor, its source is connected to VDD voltage and its drain is connected to the output port of the regulator and to a voltage divider;

said resistor wherein its first terminal is connected to the drain of said first PMOS transistor and its second terminal is connected to VDD voltage; and said block of current mirror comprising means to mirror currents having two branches wherein a first branch is connected to VDD voltage and to an entry of said gmc-filter type low-pass filter and a second branch is connected to VDD voltage and to the drain of said second NMOS transistor.

18. The circuit of claim 17 wherein said block of current mirror is having a scale of 1:1.

19. The circuit of claim 11 wherein said low pass filter is comprising a first NMOS transistor wherein its source is connected to VSS voltage and its drain is connected to said differential amplifier, providing said biasing current;

a second NMOS transistor, wherein its source is connected to VSS voltage, its drain is connected to its gate and to said first branch of said current mirror block providing the biasing current of said OTA and wherein its gate is connected to a second terminal of a capacitor and to the gate of said first NMOS transistor, forming a current mirror; and said capacitor wherein its second terminal is connected to VSS voltage.

20. The circuit of claim 19 wherein said in said current mirror the first NMOS transistor has a larger size than said second NMOS transistor.

21. The circuit of claim 20 wherein said current mirror has a scale of 2:1 amplifying the biasing current.

22. The circuit of claim 11 wherein said voltage divider is comprising two resistors wherein a first terminal of a first resistor is connected to the output port of the regulator, a second terminal of said first resistor is connected to a first terminal of a second resistor and to an input of said differential amplifier and a second terminal of a second transistor is connected to VSS voltage.

23. A method for a current mode voltage regulator to achieve dynamic biasing for the complete loop transfer function is comprising the following steps:

provide current mode voltage regulator comprising an operational amplifier (OTA) having a transconductance, which is linearly dependent on its biasing current, a low-pass filter, a voltage divider, and a current amplifier;

feed a voltage representing the output voltage of said regulator back to said OTA;

use said voltage of the previous step to control the output current of said OTA; and amplify said output current of said OTA using a constant current amplification factor to generate a biasing current of said OTA; stabilize said biasing current of said OTA; and amplify said output current of said OTA using a constant current amplification factor to generate the output current of the regulator.

24. The method of claim 23 wherein said voltage representing the output current is fed back by a voltage divider.

25. The method of claim 23 wherein said constant current amplification factor to generate said biasing current is two.

26. The method of claim 23 wherein said biasing current is stabilized using said low-pass filter.

* * * * *